US005425389A

United States Patent [19]

Johnson, Jr.

[11] Patent Number: 5,425,389

[45] Date of Patent: Jun. 20, 1995

[54] METHOD AND APPARATUS FOR CONTIGUOUS VALVE CONTROL

[75] Inventor: Harold L. Johnson, Jr., Pauline, S.C.

[73] Assignee: Milliken Research Corporation, Spartanburg, S.C.

[21] Appl. No.: 88,813

[22] Filed: Jul. 8, 1993

[51] Int. Cl.[6] ..... F16K 51/00

[52] U.S. Cl. ..... 137/1; 137/624.11; 137/624.15

[58] Field of Search ..... 137/1, 624.11, 624.14, 137/624.15

[56] References Cited

U.S. PATENT DOCUMENTS

| | | | |
|---|---|---|---|
| 3,943,973 | 3/1976 | Zettergren | 137/624.15 |
| 4,108,419 | 8/1978 | Sturman et al. | 137/624.15 X |
| 4,141,231 | 2/1979 | Kudlich . | |
| 4,156,432 | 5/1979 | Helwig, Jr. . | |
| 4,170,883 | 10/1979 | Varner . | |
| 4,174,169 | 11/1979 | Melander et al. | 137/624.15 X |
| 4,256,133 | 3/1981 | Coward et al. | 137/624.11 X |
| 4,341,098 | 7/1982 | Otting . | |
| 4,392,366 | 7/1983 | Godfrey . | |
| 4,499,920 | 2/1985 | Steffan et al. | 137/624.15 |
| 4,578,965 | 4/1986 | Brossman . | |
| 4,984,169 | 1/1991 | Johnson, Jr. . | |
| 5,128,876 | 7/1992 | Cox . | |
| 5,136,520 | 8/1992 | Cox . | |
| 5,140,686 | 8/1992 | Cox et al. . | |
| 5,142,481 | 8/1992 | Cox . | |
| 5,148,824 | 9/1992 | Wilson et al. . | |
| 5,208,592 | 5/1993 | Johnson, Jr. . | |

FOREIGN PATENT DOCUMENTS 2040230 1/1980 United Kingdom .

*Primary Examiner*—Martin P. Schwadron
*Assistant Examiner*—Kevin L. Lee
*Attorney, Agent, or Firm*—Kevin M. Kercher; Terry T. Moyer

[57] ABSTRACT

The apparatus and method for contiguous valve control. This involves the inputting of data for each of a series of valves then comparing that digital valve activation data in a one and one correspondence to the digital valve activation data that was inputted to that same series of valves in the previous machine cycle. If a particular valve was turned on in the previous machine cycle, then this valve will not be applied with voltage for a percentage of the valve's machine cycle time. There is a first circuit for generating a first voltage pulse of a first period of time, a second circuit for generating a second voltage pulse, a third circuit for generating a third voltage pulse, a fourth circuit for generating a fourth voltage pulse for a second period of time, a fifth circuit, coupled to the second circuit, third circuit, and fourth circuit for generating a fifth voltage pulse for said second period of time when the second voltage pulse and the third voltage pulse and the fourth voltage pulse are present, and the first circuit and the fifth circuit are coupled to a valve drive circuit for activating said valve for a first period of time with said first voltage pulse and deactivating said valve for a second period of time during said first period of time with said fifth voltage pulse.

20 Claims, 2 Drawing Sheets

FIG. —1—

METHOD AND APPARATUS FOR CONTIGUOUS VALVE CONTROL

BACKGROUND OF THE INVENTION

This invention relates to a method and apparatus for contiguous valve control. Typically, the time required to activate a valve is known as firing time. Firing time typically comprises of a portion of a machine cycle. Machine cycle is defined as the amount of time which is required for an electrical device such as a valve to perform its intended function. Typically, there is usually a small amount of dead time between firing times to allow the valves to turn off. In a contiguous valve system, there is no dead time between firing time cycles with the firing time equivalent to the machine cycle. With systems of this type, valves must be turned on and off in accordance with pattern data.

A major problem with this system is that some valves may already be activated so that the excess energy is dissipated in the valves that are already activated in the form of heat. This not only wastes energy but can cause serious damage to the valves.

The present invention solves this problem in a manner not disclosed in known prior art.

SUMMARY OF THE INVENTION

The apparatus and method for contiguous valve control. This involves the inputting of data for each of a series of valves then comparing that digital valve activation data in a one to one correspondence to the digital valve activation data that was inputted to that same series of valves in the previous machine cycle. If a particular valve was turned on in the previous machine cycle, then this valve will not be applied with voltage for a percentage of the valve's machine cycle time.

It is an advantage of this invention not to reactivate valves that are already turned on.

Still another advantage of this invention is not to require the dissipation of excess energy in the form of heat.

Another advantage of this invention is the avoidance of damage to valves due to re-activation when they are already activated.

These and other advantages will be a part of apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which.

DETAILED DESCRIPTION OF THE PREFERRED EMBODIMENT

Figure 1:
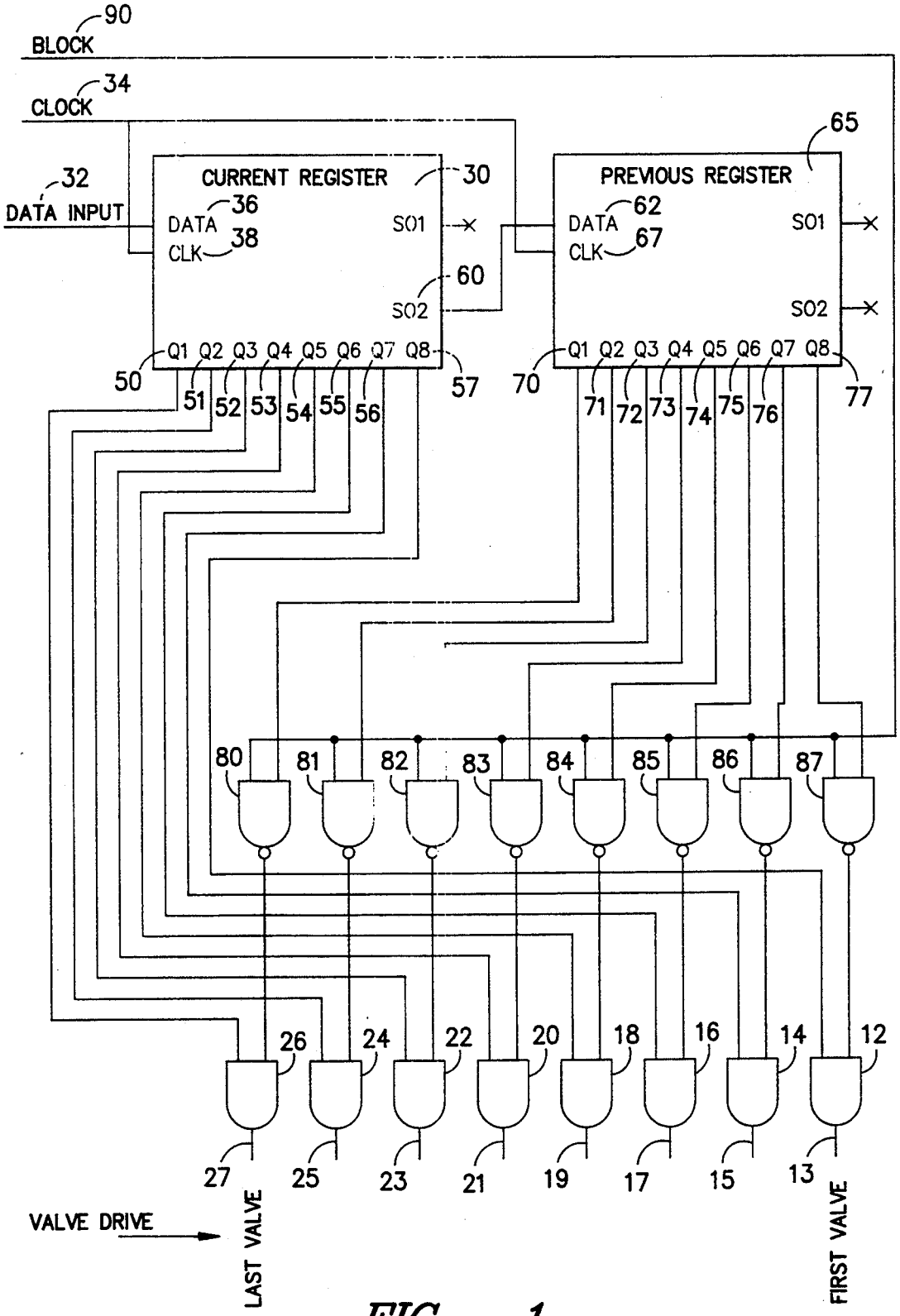
FIG. 1 is a block diagram disclosing, an overview, the novel contiguous valve control system disclosed herein.

Referring now to the accompanying drawings, and initially to FIG. 1, which shows a contiguous valve control in which each valve is controlled by a single control line. The firing time of each valve is initiated by activating a control line associated with a particular valve for a pre-determined period of time. In a contiguous valve system, the firing time and machine cycle are synonymous. Solenoid valves that are already activated dissipate excess energy in the form of heat which can result in damage to the solenoid valves. In the beginning of each machine cycle, valves may be turned on and off in accordance with computer pattern data. An excellent example of this type of technology is the pattern application of dye on a substrate wherein continuously flowing streams of liquid normally directed in paths to impinge upon the substrate are selectively deflected from contact with the substrate in accordance with pattern information. The substrate is thus dyed in a desired pattern and the deflected dye is collected and recirculated for use. Each continuously flowing liquid stream is selectively deflected by a stream of air that is discharged, in accordance with pattern information, from an air outlet located adjacent each liquid discharge outlet. The air outlet is positioned to direct the air stream into intersecting relation with the liquid stream and to deflect the liquid into a collection chamber or trough for recirculation. Each individual air stream is controlled by a solenoid valve. Therefore, for intricate patterns, the number of solenoids utilized can be extensive. The solenoid valves that are typically used in the above application normally operate at fifteen (15) volts. By increasing the voltage to 100 volts for a short period of time, just as the solenoid valve is activated, the time required to activate the valve is reduced substantially. This technique works well, however, this vast increase in voltage also results in significant power loss in the electrical conductor extending between the power source and the plurality of solenoid valves. The voltage loss in the electrical conductor is directly proportional to the number of valves activated. Therefore, when just a few solenoid valves are activated, the response time is significantly shorter then when a large number of valves are activated. The solution to the problem of voltage drop due to load variance is solved by anticipating the load and supplying additional energy by lengthening the time energy is applied. The electrical components presented in this Application are solenoid valves, however, relays, coils, resistors, and any other type of electrical component that operates as a voltage load may be utilized with this technology. In addition, any type of solenoid valve may be utilized with the fifteen volt solenoid valve illustrated as a non-limiting example.

An example of means of automatically and electronically changing from one set of pattern data to another is disclosed in U.S. Pat. No. 4,170,883, issued Oct. 16, 1979, which is hereby incorporated by reference. Other commonly assigned patents which relate to patterning substrate by utilizing the activation of valves include U.S. Pat. No. 5,208,592 issued May 4, 1993, which is hereby incorporated by reference; U.S. Pat. No. 5,140,686, issued Aug. 18, 1992, which is hereby incorporated by reference; U.S. Pat. No. 5,136,520 issued Aug. 4, 1992, which is hereby incorporated by reference; U.S. Pat. No. 4,984,169 issued Jan. 8, 1991, which is hereby incorporated by reference; U.S. Pat. No. 5,142,481, issued Aug. 25, 1992, which is hereby incorporated by reference; and U.S. Pat. No. 5,128,876, issued Jul. 7, 1992, which is hereby incorporated by reference.

Figure 2:
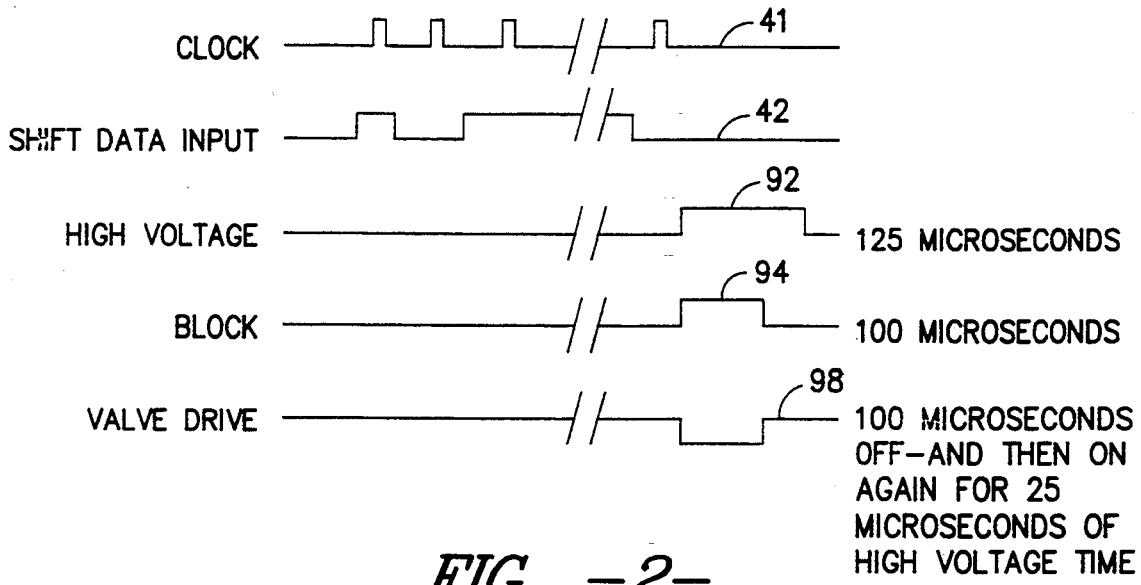
FIG. 2 is a diagram of a clock voltage pulse, shift data in voltage pulse, high voltage pulse, block voltage pulse, and valve drive pulse that represents when a valve that is turned on from the previous machine cycle.
Figure 3:
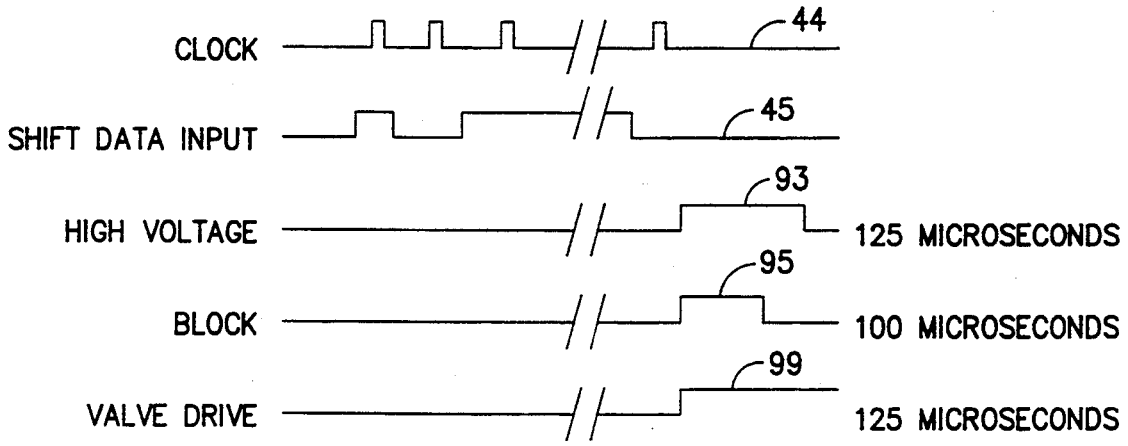
FIG. 3 is a diagram of clock voltage pulse, shift data in voltage pulse, high voltage pulse, block voltage pulse, valve drive voltage pulse, corresponding to FIG. 2 that represents a valve that was not turned on in the previous machine cycle.

As shown in FIG. 1, serial data is inputted into a current shift register 30 by means of a data input 32. A non-limiting example of current shift registers of this type would include 74HC4094. This data is actually sequentially clocked into this register by means of clock line 34. Data input line 32 is electrically connected to data input terminal 36 of current shift register 30. Clock line 34 is electrically connected to clock input terminal 38 of current shift register 30. A representative clock pulse that can be found on clock line 34 is pictorially represented by numeral 41 in FIG. 2 and numeral 44 in FIG. 3. A data input voltage pulse that can be found on data input 32 is pictorially represented by numerals 42 in FIG. 2 and numeral 45 in FIG. 3. Although, there can be any number of output terminals associated with current register 30, in a preferred embodiment there are eight output terminals represented as Q1, Q2, Q3, Q4, Q5, Q6, Q7 and Q8 designated by numerals 50, 51, 52, 53, 54, 55, 56, and 57, respectively. Output terminals 50, 51, 52, 53, 54, 55, 56, and 57 of current register 30 are electrically connected to one of two inputs of a series of AND gates numerically designated as 26, 24, 22, 20, 18, 16, 14 and 12, respectively. A non-limiting example of AND gates of this type would include 74H08. The valve activation data leaves current register 30 by means of serial output S02 designated by numeral 60 which is electrically connected to data input terminal 62 of a previous shift register as generally indicated by numeral 65. A nonlimiting example of a shift register of this type is 74HC4094. This serial data is clocked into previous register 65 by means of electrical connection between clock line 34 and clock input terminal 67. Once again, the clock voltage pulse representations are indicated by numerals 41 and 44 on FIGS. 2 and 3, respectively, and the data shift in voltage pulses are indicated by numerals 42 and 45 on FIGS. 2 and 3, respectively. The preferred embodiment of previous shift register 65 also has eight output terminals. Output terminal Q1 is designated by numeral 70, output terminal Q2 is designated by numeral 71, output terminal Q3 is designated by numeral 72, output numeral Q4 is designated by numeral 73, output terminal Q5 is designated by numeral 74, output terminal Q6 is designated by numeral 75, output terminal Q7 is designated by numeral 76, and output terminal Q8 is designated by numeral 77. These output lines 70, 71, 72, 73, 74, 75, 76 and 77 are electrically connected to one of two inputs to a series of preferably eight NAND gates numerically designated as 80, 81, 82, 83, 84, 85, 86 and 87, respectively. A non-limiting example of NAND gates 80, 81, 82, 83, 84, 85, 86, and 87 at this type would include 74HC00. The remaining second input connections to NAND gates 80, 81, 82, 83, 84, 85, 86, and 87 are connected to block line 90. Block line 90 is a voltage pulse which is on for a percentage of time of the total time in which the high voltage pulse is applied to the valve. As shown in FIG. 2, the high voltage pulse is designated by numeral 92. In FIG. 3, the high voltage pulse is designated by numeral 93. A block voltage pulse is preferably a significant period of time in relation to the total period of time in which the high voltage pulse is applied to the valve. In the preferred embodiment the high voltage pulse is in a high state for 125 microseconds while the block voltage pulse is activated in a high state for 100 microseconds. Block voltage pulse is shown in FIG. 2 as numeral 94 and is shown in FIG.3 as numeral 95.

Therefore, the output of NAND gates 80, 81, 82, 83, 84, 85, 86 and 87 will always be in a digital "one" state unless there is a positive block voltage pulse 94, 95 at the same time the output terminal of either 70, 71, 72, 73, 74, 75, 76 or 77 of previous register 75 is in a digital "one" state or high state. Otherwise, in all remaining conditions of the output of NAND gates 80 through 87 will be in a digital "one" state. The outputs from NAND gates 80 through 87 are inputted to respective AND gates 26, 24, 22, 20, 18, 16, 14 and 12 in conjunction with the digital output terminals 50, 51, 52, 53, 54, 55, 56 and 57. The output from AND gates 26, 24, 22, 20, 18, 16, 14 and 12 are outputted to control lines 27, 25, 23, 21, 19, 17, 15 and 13, respectively. These control lines actuate the valves.

Therefore, according to FIG. 2, the valve drive will be continually activated except when there is a block voltage pulse 94 in conjunction with a digital "one" state on one of the output terminals 70 through 77. This will result in voltage pulse 98 in which the respective valve drive will be off for the initial 100 microseconds and then on for the last 25 seconds of a total of 125 microsecond activation time. This is shown by high voltage 92, block voltage 94 and valve drive voltage 98, respectively, in FIG. 2.

FIG. 3 represents the condition when there are no digital "ones" states present on any one of outputs 70 through 77 of previous shift register 65. The valve drive voltage 99 will then be on continually and there will not be a period of time in which the valve drive voltage 99 will be turned off. It is because high voltage pulse 93 is turning on the valve for the first time and this valve was not on during the previous machine cycle.

The digital components presented throughout this application are exemplary and illustrative and are not deemed to be limiting in any way. Therefore, it is not intended the scope of the invention be limited to specific embodiments illustrated and described. Rather, it is intended that the scope of the invention be defined by the independent claims and their equivalence.

What is claimed is:

1. A system for controlling the operation of a valve comprising of:

(a) a first circuit for generating a first voltage pulse of a first period of time;

(b) a second circuit for generating a second voltage pulse;

(c) a third circuit for generating a third voltage pulse;

(d) a fourth circuit for generating a fourth voltage pulse for a second period of time;

(e) a fifth circuit, coupled to said second circuit, third circuit, and fourth circuit for generating a fifth voltage pulse for said Second period of time when said second voltage pulse and said third voltage pulse and said fourth voltage pulse are present; and (f) said first circuit and said fifth circuit are coupled to a valve drive circuit for activating said valve for a first period of time with said first voltage pulse and deactivating said valve for a second period of time during said first period of time with said fifth voltage pulse.

2. A system for controlling the operation of a plurality of valves comprising of:

(a) a first circuit for generating a plurality of first voltage pulses of a first period of time;

(b) a second circuit for generating a plurality of second voltage pulses;
(c) a third circuit for generating a plurality of third voltage pulses;
(d) a fourth circuit for generating a plurality of fourth voltage pulses for a second period of time;
(e) a fifth circuit, coupled to said second circuit, third circuit, and fourth circuit for generating a plurality of fifth voltage pulses for said second period of time when said plurality of second voltage pulses and said plurality of third voltage pulses and said plurality of fourth voltage pulses are present; and
(f) said first circuit and said fifth circuit are coupled to a valve drive circuit for activating said valve for a first period of time with said plurality of first voltage pulses and deactivating said valve for a second period of time during said first period of time with said plurality of fifth voltage pulses.

3. A system for controlling the operation of a plurality of valves comprising of:
(a) a first circuit for generating a plurality of first voltage pulses of a first period of time;
(b) a second circuit for converting a first set of serial data into a plurality of second voltage pulses;
(c) a third circuit for converting a second set of serial data into a plurality of third voltage pulses;
(d) a fourth circuit for generating a plurality of fourth voltage pulses for a second period of time;
(e) a fifth circuit, coupled to said second circuit, third circuit, and fourth circuit for generating a plurality of fifth voltage pulses for said second period of time when said plurality of second voltage pulses and said plurality of third voltage pulses and said plurality of fourth voltage pulses are present; and
(f) said first circuit and said fifth circuit are coupled to a valve drive circuit for activating said valve for a first period of time with said plurality of first voltage pulses and deactivating said valve for a second period of time during said first period of time with said plurality of fifth voltage pulses.

4. A system for controlling the operation of a plurality of valves as defined in claim 3, wherein said second circuit for converting said first set of serial data into a plurality of second voltage pulses includes a first data shift register.

5. A system for controlling the operation of a plurality of valves as defined in claim 3, wherein said third circuit for converting said second set of serial data into a plurality of third voltage outputs includes a second data shift register.

6. A system for controlling the operation of a plurality of valves as defined in claim 3, wherein said fifth circuit includes a plurality of NAND gates for detecting said plurality of said third voltage pulses in conjunction with at least one of said fourth voltage pulses.

7. A system for controlling a plurality of valves as defined in claim 6, wherein said fifth circuit includes a plurality of AND gates whereby said second circuit and said NAND gates are inputted thereto.

8. A system for controlling the operation of a plurality of valves as defined in claim 5, further comprising an connection between a serial data output of said first data shift register and a serial data input of said second data shift register.

9. A system for controlling the operation of a plurality of valves as defined in claim 8, further comprising a clock line for receiving periodic voltage pulses connected to said first data shift register and said second data shift register for inputting said first set of serial data into said first data shift register and inputting said second set of serial data into said second data shift register which was previously stored in said first data shift register.

10. A system for controlling a plurality of valves as defined in claim 5, wherein said fourth circuit for generating a plurality of fourth voltage pulses include a plurality of block voltages.

11. A system for controlling a plurality of valves as defined in claim 10, wherein said fifth circuit includes a plurality of NAND gates for detecting said presence of said third voltage pulse in conjunction with each respective said fourth voltage pulse.

12. A system for controlling a plurality of valves as defined in claim 11, wherein said fifth circuit includes a series of AND gates whereby said second circuit and said NAND gates are inputted thereto.

13. A process for controlling the operation of a valve comprising the steps of:
(a) generating a first voltage pulse of a first period of time;
(b) generating a second voltage pulse;
(c) generating a third voltage pulse;
(d) generating a fourth voltage pulse for a second period of time;
(e) generating a fifth voltage pulse for said second period of time when said second voltage pulse and said third voltage pulse and said fourth voltage pulse are present; and
(f) activating said valve for a first period of time with said first voltage pulse and deactivating said valve for a second period of time during said first period of time with said fifth voltage pulse.

14. A process for controlling the operation of a plurality of valves comprising the steps of:
(a) generating a plurality of first voltage pulse of a first period of time;
(b) generating a plurality of second voltage pulse;
(c) generating a third voltage pulse;
(d) generating a fourth voltage pulse for a second period of time;
(e) generating a plurality of fifth voltage pulses for said second period of time when said second voltage pulses and said third voltage pulses and said fourth voltage pulses are correspondingly present; and
(f) activating said valve for a first period of time with said plurality of first voltage pulses and deactivating said valve for a second period of time during said first period of time with said plurality of fifth voltage pulses.

15. A process for controlling the operation of a plurality of valves comprising the steps of:
(a) generating a plurality of first voltage pulses of a first period of time;
(b) converting a first set of serial data into a plurality of second voltage pulses;
(c) converting a second set of serial data into a plurality of third voltage pulses;
d) generating a plurality of fourth voltage pulses for a second period of time;
(e) generating a plurality of fifth voltage pulses for said second period of time when said second voltage pulses and said third voltage pulses and said fourth voltage pulses are correspondingly present; and (f) activating said valve for a first period of time with said plurality of first voltage pulses and deactivating said valve for a second period of time during said first period of time with said plurality of fifth voltage pulses.

16. A process for controlling the operation of a plurality of valves comprising the steps of:

(a) generating a plurality of first voltage pulses of a first period of time;

(b) converting a first set of serial data into a plurality of second voltage pulses by means including a first data shift register;

(c) converting a second set of serial data into a plurality of third voltage pulses;

(d) generating a plurality of fourth voltage pulses for a second period of time;

(e) generating a plurality of fifth voltage pulses for said second period of time when said second voltage pulses and said third voltage pulses and said fourth voltage pulses are correspondingly present; and (f) activating said valve for a first period of time with said plurality of first voltage pulses and deactivating said valve for a second period of time during said first period of time with said plurality of fifth voltage pulses.

17. A process for controlling the operation of a plurality of valves comprising the steps of:

(a) generating a plurality of first voltage pulses of a first period of time;

(b) converting a first set of serial data into a plurality of second voltage pulses by means including a first data shift register;

(c) converting a second set of serial data into a plurality of third voltage pulses by means of a second data shift register;

(d) generating a plurality of fourth voltage pulses for a second period of time;

(e) generating a plurality of fifth voltage pulses for said second period of time when said second voltage pulses and said third voltage pulses and said fourth voltage pulses are correspondingly present; and (f) activating said valve for a first period of time with said plurality of first voltage pulses and deactivating said valve for a second period of time during said first period of time with said plurality of fifth voltage pulses.

18. A process for controlling the operation of a plurality of valves as defined in claim 17, further comprising the step of connecting a serial data output of said first data shift register to a serial data input of said second data shift register.

19. A process for controlling the operation of a plurality of valves as defined in claim 17, further comprising the step of generating periodic voltage pulses connected to said first data shift register and said second data shift register for shifting said first set of serial data into said first data shift register and inputting said second set of serial data into said second data shift register which was previously stored in said first data shift register.

20. A process for controlling the operation of a plurality of valves comprising the steps of:

(a) generating a plurality of first voltage pulses of a first period of time;

(b) converting a first set of serial data into a plurality of second voltage pulses by means including a first data shift register;

(c) converting a second set of serial data into a plurality of third voltage pulses by means of a second data shift register;

(d) generating a plurality of fourth voltage pulses for a second period of time;

(e) generating a plurality of fifth voltage pulses for said second period of time when said second voltage pulses and said third voltage pulses and said fourth voltage pulses are correspondingly present by means of inputting said third and fourth voltage pulses into a plurality of NAND gates and imputing the output of said plurality of NAND gates into a plurality of AND gates with said second voltage pulses; and (f) activating said valve for a first period of time with said plurality of first voltage pulses and deactivating said valve for a second period of time during said first period of time with said plurality of fifth voltage pulses.

* * * * *